US005370428A

United States Patent [19]

Dreifert et al.

[11] Patent Number: 5,370,428

[45] Date of Patent: Dec. 6, 1994

[54] MECHANISM FOR RELEASABLY LOCKING SASHES IN DOOR-OR WINDOW FRAMES

[75] Inventors: Karl-Heinz Dreifert, Velbert; Erhard Kuhnt, Heiligenhaus, both of Germany

[73] Assignee: Wilhelm Weidtmann GmbH & Co. KG, Velbert, Germany

[21] Appl. No.: 72,492

[22] Filed: Jun. 4, 1993

[30] Foreign Application Priority Data

Aug. 25, 1992 [DE] Germany ..... 4228132

[51] Int. Cl.[5] ..... E05C 1/12

[52] U.S. Cl. ..... 292/161; 292/40; 292/162; 292/DIG. 62

[58] Field of Search ..... 292/40, 161, 156, DIG. 5, 292/DIG. 62, 157, 158, 159, 160, 162

[56] References Cited

U.S. PATENT DOCUMENTS 4,991,886 2/1991 Nolte et al. ..... 292/161
5,201,557 4/1993 Schlack ..... 292/161

FOREIGN PATENT DOCUMENTS

7140320U1 1/1972 Germany .
2341263 8/1973 Germany .
2755079C3 12/1977 Germany .
8117315U1 6/1981 Germany .
374878 10/1981 Germany .
3150128A1 12/1981 Germany .
3603543A1 2/1986 Germany .
3633853C2 10/1986 Germany .
2227051A 7/1989 United Kingdom .

OTHER PUBLICATIONS

DE-Z. Sicherheitsbeschläge: Mit hochwertigem; System Fenster und Fenstertüren optimal sichern. in: Bau-und Möbelschreiner, 191, H. 10, S. 110 Oct. 1991.

*Primary Examiner*—Rodney M. Lindsey
*Attorney, Agent, or Firm*—Darby & Darby

[57] ABSTRACT

A door- or window sash which is pivotable relative to a door- or window frame between open and closed positions can be releasably affixed to the frame in the closed position in response to turning of a handle which can shift an elongated carrier relative to the frame between two spaced-apart end positions. The carrier supports a series of longitudinally spaced-apart projections each of which fully engages a complementary retainer on the sash during different stages of movement of the handle from one end position to the other end position. The arrangement may be such that the projection nearest to the handle is first to engage the complementary retainer on the sash, that the projection which is adjacent the nearest projection is next to engage the corresponding retainer, and so on. A safety device can be provided to releasably lock the carrier in the other end position.

26 Claims, 7 Drawing Sheets 33
49
60
40'
40
40''
47
16
61
15
13
12
14
52
53
56
50
18
70
62e
62f
62a
33a
60a
40a'
40a
40a''
61a
15a
12a
62b
23
33 b
40b'
40b
40b''
60b
63
61b
15b
12b
21
20
30
11
10
62c
62d
33c
60c
40c'
40c
40c''
61c
15c
12c
62c
33d
60d
40d'
40d
40d''
51
61d
15d
12d
62d
19
33e
60e
40e'
40e
40e''
61e
15e
12e
62e
33f
60f
40f'
40f
40f''
61f
15f
12f
62f

V
V
VI
VII
21
22
23
24
25
26
27
28
29
31
32
34
35
36
37
40
41
42
43
44
46

90
40'
80'
40'
51

40
80
91
40

90
40'''
40'''

90
40''
80''
40''
92
77

MECHANISM FOR RELEASABLY LOCKING SASHES IN DOOR-OR WINDOW FRAMES

CROSS-REFERENCE TO RELATED CASE

The mechanism of the present invention embodies or can embody a locking/unlocking device of the type disclosed in commonly owned copending patent application Ser. No. 08/049,087 filed Apr. 20, 1993 by Karl-Heinz Dreifert for "Device for locking and unlocking sashes in door- or window frames". The disclosure of the copending application Ser. No. 08/049,087 is incorporated herein by reference.

BACKGROUND OF THE INVENTION

The invention relates to improvements in mechanisms which can be used to releasably lock a mobile first component in a predetermined position relative to a second component. More particularly, the invention relates to improvements in mechanisms which can be utilized with advantage to releasably lock pivotable and/or otherwise movable sashes in door- or window frames.

It is known to provide a door or a window with a mechanism which serves to releasably lock a mobile component (such as the sash of a casement window or the sash of a door and hereinafter called sash) to a second component (e.g., to a door frame or a window frame and hereinafter called frame) by manipulating a knob, a lever or another suitable handle in order to engage one or more female or male (first) locking elements on the sash with one or more male or female (second) locking elements on the frame. The handle can be provided on the sash and the first locking elements are then displaced by the handle when the sash assumes a closed position in which the second locking elements (on or in the frame) are supposed to be ready for engagement by the first locking elements. Such mechanisms operate quite satisfactorily if the sash carries a single first locking element which can engage a single second locking element on or in the frame. However, the situation is quite different if the sash carries a number of spaced apart first locking elements each of which is to engage a discrete second locking element, for example, when the sash is to be locked to its frame at a large number of locations spaced apart from each other along the entire periphery, or along a large portion of the periphery, of the sash. In such instances, the sash can include one or more elongated motion receiving parts, e.g., in the form of bars, which are coupled to the handle and carry a large number of pins or otherwise configurated (first) locking elements each of which must ultimately engage a discrete second locking element on the frame. For example, the first locking elements can constitute pins or analogous followers which are to engage discrete ramps, cams or like parts on the frame in response to actuation of the handle while the sash is maintained in a closed position. When the manipulation of the handle in a direction toward locking of the sash to the frame (while the sash is maintained in the closed position) is completed, each first locking element forms with the complementary second locking element a discrete lock which fixedly secures the corresponding portion of the sash to the adjoining portion of the frame. It is immaterial whether the handle and the motion receiving part(s) are mounted on the sash or on the frame.

The motion receiving elements can include bars or strips which are reciprocably mounted in grooves provided therefor in the sash or in the frame; this ensures that the distance between the handle and that first locking element which is remotest from the handle is a multiple of the distance of the handle from the nearest first locking element. The second locking elements are or can be mounted on or in the frame in such a way that the distance between the handle and the second locking element nearest to the handle is half the distance of the next second locking element and so forth. When the handle is manipulated to lock the sash to the frame, all of the first locking elements are supposed to simultaneously engage the respective second locking elements. However, this is possible only if each first locking element is properly positioned relative to the respective second locking element when the movement (e.g., pivoting) of the sash to the closed position (relative to the frame) is completed. Such situation is not likely to arise if the sash carries a substantial number of first locking elements and if the frame carries an equally large number of second locking elements. The reason is that the frame and/or the sash is likely to undergo at least some deformation for any one of a number of different reasons, e.g., due to thermally induced expansion or contraction, due to excessive stressing and resulting deformation and/or for other reasons.

If at least one of the first locking elements does not accurately register with the associated second locking element, the entire mechanism becomes inoperative because the handle cannot be moved away from a predetermined first position which it must assume in order to permit pivoting and/or other movements of the sash to or from the closed position. Furthermore, if a first locking element is caused to assume an improper position relative to the adjacent second locking element in response to movement of the handle and of the motion receiving element or elements toward locking position, the mechanism is likely to break, to cause a pronounced deformation of one or more of its parts, or to develop a substantial clearance between two or more neighboring portions of the sash and frame.

The likelihood of improper positioning of first locking elements relative to the adjacent second locking elements is especially pronounced if the door or window embodying the sash and the frame therefor is relatively large so that at least some of the first and second locking elements are located at a considerable distance from the handle. Thus, one or more first locking elements which are nearest to the handle are likely to be properly aligned with the corresponding second locking elements; however, a third, fourth, etc. first locking element is much less likely to be adequately aligned with the third, fourth, etc. second locking element when the sash is held in the closed position but is yet to be locked to the frame. This necessitates manual depression of selected portions of the sash (namely the portions remote from the handle) to the fully closed position or positions before the handle can be manipulated in order to lock the sash to the frame. In the absence of such undertaking (to move the entire sash to its closing position), the operator is unable to manipulate the handle and is likely to leave the sash unlocked or to damage the sash, the frame and/or the locking mechanism. If the entire sash does not assume its closed position at the time the handle is manipulated in a sense to lock the sash to the frame, one or more first locking elements are bound to strike portions of the adjacent second locking elements, the nonaligned first locking elements are bound to prevent full movement of the handle to an end position in which the sash is locked to the frame; or the nonaligned first locking elements are free to move along the adjacent second locking elements but not to positions which are required to lock the corresponding portions of the sash and frame to each other; or the mechanism including the handle, the motion receiving element or elements and/or the first and/or second locking elements is damaged or destroyed; and/or certain first locking elements and the corresponding second locking elements cooperate to widen the gap between the sash and the frame when the movement of the handle to a locking position is completed.

Manual depression of a single deformed portion of a sash (in order to move such portion to the closed position) is conceivable (i.e., possible) under certain circumstances, namely when the manual depression is to be carried out by a grown person and does not necessitate the application of a substantial force such as is not expected from a convalescent, a senior citizen and/or a lady. However, even a very strong person cannot ensure that the entire sash is moved to the closed position if two or more spaced apart portions of the sash are to be depressed while the sash portion adjacent the handle is already maintained in the closed position. In other words, it is then necessary that the person attempting to close and lock the sash seek assistance from at least one other person. This is not only cumbersome but also impossible if another person is not available to assist the operator of the door or window embodying one or more frames and an equal number of sashes.

OBJECTS OF THE INVENTION

An object of the invention is to provide a simple, compact and inexpensive mechanism which can reliably lock a movable component to a second component, for example, which can lock a pivotable and/or otherwise movable sash to a door- or window frame.

Another object of the invention is to provide a locking/unlocking mechanism which can be installed in existing windows or doors as a superior substitute for existing mechanisms.

A further object of the invention is to provide a novel and improved mechanism which can reliably lock a plurality of spaced apart portions of a sash to adjoining portions of a frame in a door, in a window or in a like structure.

An additional object of the invention is to provide a novel and improved combination of stationary and movable locking elements for use in the above outlined mechanism.

Still another object of the invention is to provide a mechanism which need not be manipulated by two or more persons.

A further object of the invention is to provide a mechanism which can be properly manipulated by a single hand of an operator, i.e., by the hand which is used to manipulate the handle.

Another object of the invention is to provide a mechanism which can be actuated with the exertion of a small force.

An additional object of the invention is to provide a mechanism wherein the cooperating first and second locking elements can be readily moved into engagement with each other or disengaged from one another in response to the exertion of a relatively small force.

Still another object of the invention is to provide a window or a door which embodies a mechanism of the above outlined character.

A further object of the invention is to provide a novel and improved method of locking a sash to, or unlocking a sash from, a door- or window frame.

Another object of the invention is to provide a locking/unlocking mechanism which is assembled from a small number of simple parts and wherein the number of cooperating first and second locking elements can be selected practically at will.

An additional object of the invention is to provide a mechanism which can stand long periods of use.

SUMMARY OF THE INVENTION

The invention resides in the provision of a mechanism for separably connecting a first component (e.g., the frame of a casement window) with a second component (e.g., the sash of a casement window) which is movable relative to the first component between open and closed positions (for example, the sash can be tilted between closed and open positions about a substantially horizontal axis or about a substantially vertical axis). The improved mechanism comprises an elongated carrier (e.g., an elongated strip or bar of metal, plastic or other suitable material) which is provided on and is movable longitudinally relative to one of the first and second components (e.g., relative to the first component), and a device (e.g., a device including a handle which is actuatable, e.g., turnable or pivotable through an angle of approximately 180°) for moving the carrier relative to the one component between spaced-apart first and second end positions, at least in the closed position of the second component. The carrier has a motion receiving portion (e.g., in the form of a post or stud) which is engaged by the moving device at least in the closed position of the second component, and the mechanism further comprises a first and a second locking assembly. The first locking assembly includes a plurality of detent members including first and second detent members which are provided on the other component, and the second locking assembly comprises a plurality of detent elements including first and second detent elements provided on the carrier and respectively disposed at a first and at a greater second distance from the motion receiving portion of the carrier, at least in the closed position of the second component. The first detent element engages the first detent member to lock a first portion of the second component to the first component in the closed position of the second component in response to movement of the carrier in a direction from one of the first and second end positions toward the other end position, and the second detent element thereupon engages the second detent member to thereby lock a second portion of the second component to the first component in response to further movement of the carrier in the aforementioned direction, i.e., from the first end position toward the second end position.

The first component can include or constitute the frame of a door or window, and the second component can include or constitute a sash of a door or window. The detent elements can include projections of the carrier and the detent members can include retainers for the respective projections. The one component is preferably provided with suitable guide means for the carrier, and the projections are spaced apart from each other in the aforementioned direction.

The second locking assembly preferably comprises at least three projections which are equidistant from each other in the longitudinal direction of the elongated carrier. Such carrier can be provided with sockets and each projection of the second locking assembly can be anchored in and then extends from one of the sockets.

The first locking assembly preferably comprises at least three equidistant detent members, and the projections are spaced apart from each other a first distance which is less than a second distance between neighboring detent members. The guide means can comprise a plurality of discrete guides for spaced-apart portions of the carrier, and each of these spaced-apart portions of the carrier can include a socket for one of the projections. The discrete guides have means for confining the respective projections to movement along predetermined paths relative to the guide means and for preventing movements of the carrier and the projections relative to each other.

In accordance with a presently preferred embodiment, the guide means comprises a plurality of identical guides, the second locking assembly comprises a plurality of identical projections, and the first locking assembly comprises a plurality of identical retainers. The carrier and the guide means can constitute a preassembled unit, and such mechanism can further comprise locating means for temporarily securing the guides of the composite (multiple-guide) guide means to the carrier. The locating means can comprise spaced-apart pins in one of the parts including the carrier and the guides and complementary recesses in the other of these parts (i.e., in the guides or in the carrier). The pins can be constructed and mounted in such a way that they can be expelled from the respective recesses in response to first actuation of the moving device. Alternatively, the pins can be constructed and mounted in such a way that they are automatically sheared off by the carrier or by the guides in response to first actuation of the moving device.

The mechanism further comprises means for fastening the guides to the one component (e.g., to the frame), and the locating means can include means for temporarily maintaining the carrier in an intermediate position substantially midway between the two end positions prior to first actuation of the moving device.

The carrier can be provided with at least one slot between two of the aforementioned projections, and the moving device can be actuated to move the carrier through a predetermined distance between the two spaced-apart end positions. The slot has a length which at least matches the predetermined distance. The mechanism also comprises means for fastening the guide means to the one component, and such fastening means can include a fastener extending through the at least one slot. The aforementioned locating means can include means for temporarily securing the guide means to the carrier, and such securing means can include a portion of the at least one slot.

The carrier can constitute a length of a continuous elongated blank (e.g., an extrusion) having a pattern of longitudinally spaced-apart sockets for portions of the projections forming part of the second locking assembly. The aforementioned length of the continuous blank can further comprise a pattern of longitudinally spaced-apart elongated slots and at least one hole. The motion receiving portion of the carrier can be installed in the at least one hole. Still further, the length of the continuous blank can further comprise at least one longitudinally extending slot having an enlarged portion, and the mechanism can comprise the aforementioned locating means serving to temporarily secure the guide means to the carrier. The locating means can comprise a pin which is provided on the guide means and extends into the enlarged portion of the at least one slot.

The discrete guides of the composite (multiple-guide) guide means surround spaced-apart portions of the carrier and are affixed to the one component. Each guide can comprise a plurality of separable sections which define elongated channels serving to slidably receive portions of the carrier for movement between the end positions. Each guide can comprise a first elongated section which is disposed between the one component and the carrier, and a second elongated section which overlies a portion of the carrier and is affixed to the first section. The two sections of each discrete guide can be provided with complementary male and female detents which engage each other to prevent accidental separation of the first and second sections from each other. One section of each discrete guide can be provided with at least one male centering member, and the other section of each pair then comprises a complementary female centering member. The fastening means which secures the guides to the one component can comprise at least one fastener for each guide, and each such fastener can extend through the complementary male and female centering members of the respective guide.

The male and/or the female centering member can be positioned in line with a discrete slot of the carrier, and the fastening means can include fasteners which extend through the centering members and the respective slots.

The projections of the second locking assembly can extend through slots which are provided in the respective guides, e.g., in one section of each guide. The slots in the sections of the guides have a length which at least matches the aforementioned predetermined distance, i.e., the distance between the two end positions of the carrier.

Each projection can include an enlarged end portion (e.g., a head resembling a rivet head) which is received in and is movable along an elongated recess or depression of the respective guide. The recess or depression can be provided in one section of each guide, and the other section of each guide is then provided with a slot for the shank or main portion of the respective projection; this enables the projections to share the movements of the carrier in that they move relative to the respective guides. The length of each recess can at least match the distance between the end positions of the carrier. Each projection can resemble a hat and then includes an elongated cylindrical portion or shank which extends through the respective slot.

In accordance with an additional feature of the invention, the mechanism can further include means for releasably securing the carrier in the other end position, i.e., in a position such that the carrier cannot be accidentally shifted to a position in which the second component can be moved relative to the first component. The securing means can comprise at least one protuberance which is provided on the carrier and a female securing element which is provided on the other component and is engaged by the at least one protuberance in response to movement of the carrier at least close to the other end position. The at least one protuberance can include an enlarged head, and the female securing element can be provided with a channel which receives the head in the other end position of the carrier. The carrier can be provided with a plurality of equidistant holes (e.g., in the form of bores), and the at least one protuberance can be anchored in one of such holes. The holes can be distributed in such a way that they alternate with the projections of the second locking assembly in the longitudinal direction of the carrier.

The at least one protuberance can be directly connected to the carrier; for example, such protuberance can be riveted to the carrier.

Alternatively, the securing means can comprise means for movably coupling the at least one protuberance to the carrier, and such coupling means then comprises means for confining the at least one protuberance to movements between two end positions longitudinally of the carrier. Such coupling means can comprise an elongated link which is rigid with the at least one protuberance, and means for longitudinally movably connecting the link to the carrier. The link can be provided with at least one elongated slot, and the connecting means can include at least one of the projections forming part of the second locking assembly. Such one projection extends into the at least one slot of the link. A second guide means can be provided on the carrier, and such second guide means includes means for confining the link to movements longitudinally of the carrier. For example, the second guide means can comprise a cover which is affixed to the guide means for the carrier and defines with such guide means a channel which confines the link to movements longitudinally of the carrier. The mechanism then further comprises means for affixing the cover to the guide means for the carrier and for simultaneously fastening the guide means for the carrier to the one component. The affixing means can comprise threaded fasteners.

The one projection can extend into the at least one slot of the link with a predetermined clearance so that the link and the one projection can perform idle strokes relative to each other.

The novel features which are considered as characteristic of the invention are set forth in particular in the appended claims. The improved mechanism itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figures 1A, 1B:
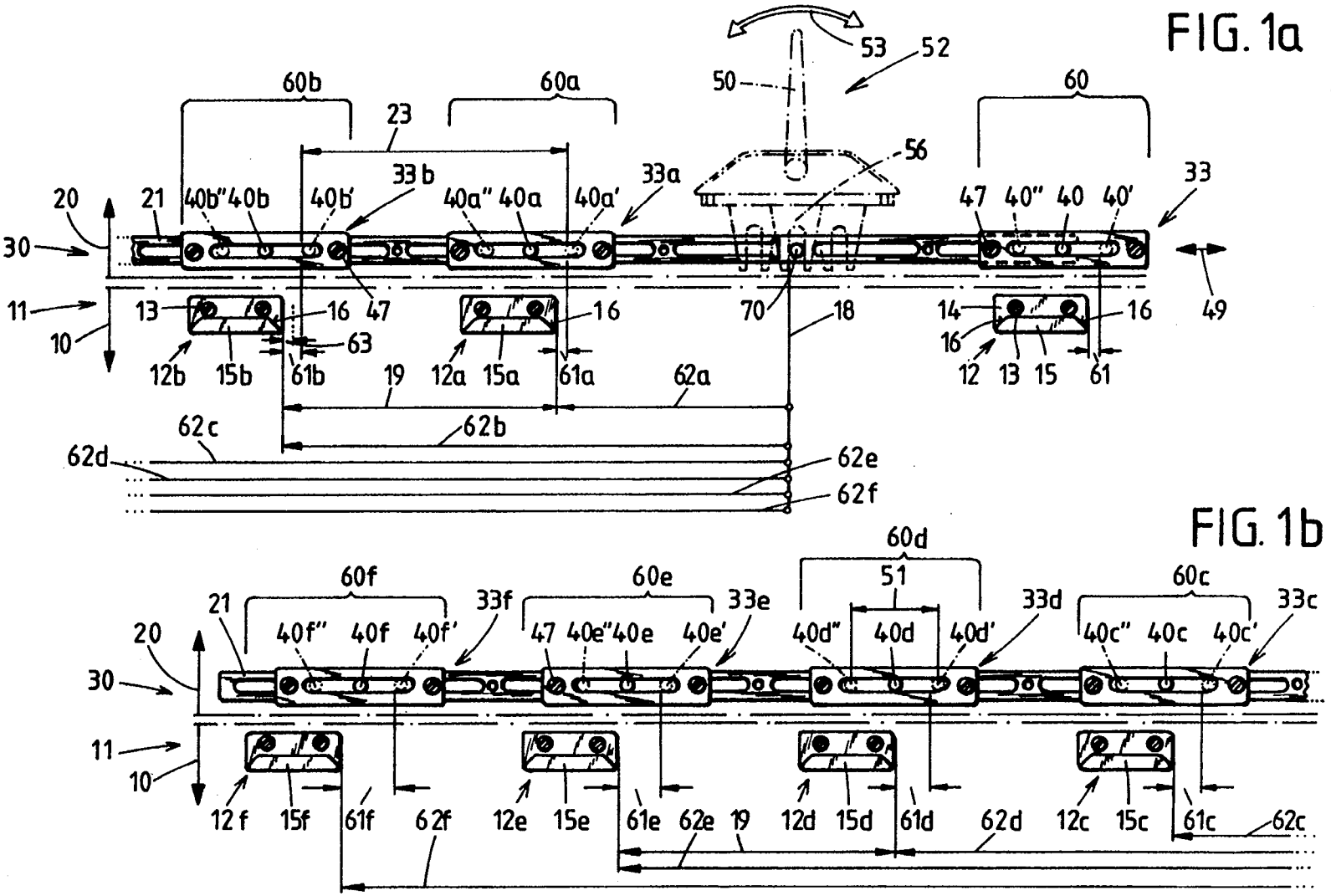
FIG. 1*a* is a schematic front elevational view of a portion of a mechanism which embodies one form of the invention, the projections of the second locking assembly being disengaged from the respective retainers of the first locking assembly.
FIG. 1*b* is a similar schematic front elevational view of the remaining portion of the mechanism.

FIGS. 1*a* and 1*b* show a preassembled unit 30 including a fixed component 20 (hereinafter called frame) and a second preassembled unit 11 including a mobile component 10 (hereinafter called sash). The frame 20 carries certain parts of the improved locking/unlocking mechanism; such parts include an elongated carrier 21 which is guided in a groove 20*a* (FIG. 3) of the frame 20, a plurality of locking elements or detents 40 in the form of pin- or stud-shaped projections (hereinafter called pins), and a device 52 (see also FIG. 2) which can be manipulated by hand in order to move the carrier 21 in the groove 20*a* of the frame 20 between two spaced-apart end positions. The sash 10 carries the additional parts of the locking/unlocking mechanism; such parts include a discrete locking element or detent member 12, one for each of the pins 40 and each movable with the sash 10 between at least one first position in which the door or window is open because the sash is not in closing engagement with the frame 20, and a second position in which the sash 10 is closed and each of the locking elements 12 (hereinafter called retainers) is in a predetermined position relative to the nearest pin 40. The detent members 12 are affixed to the sash 10 by fasteners 13 and are recessed into the sash, as at 68 (FIG. 3).

Figure 3:
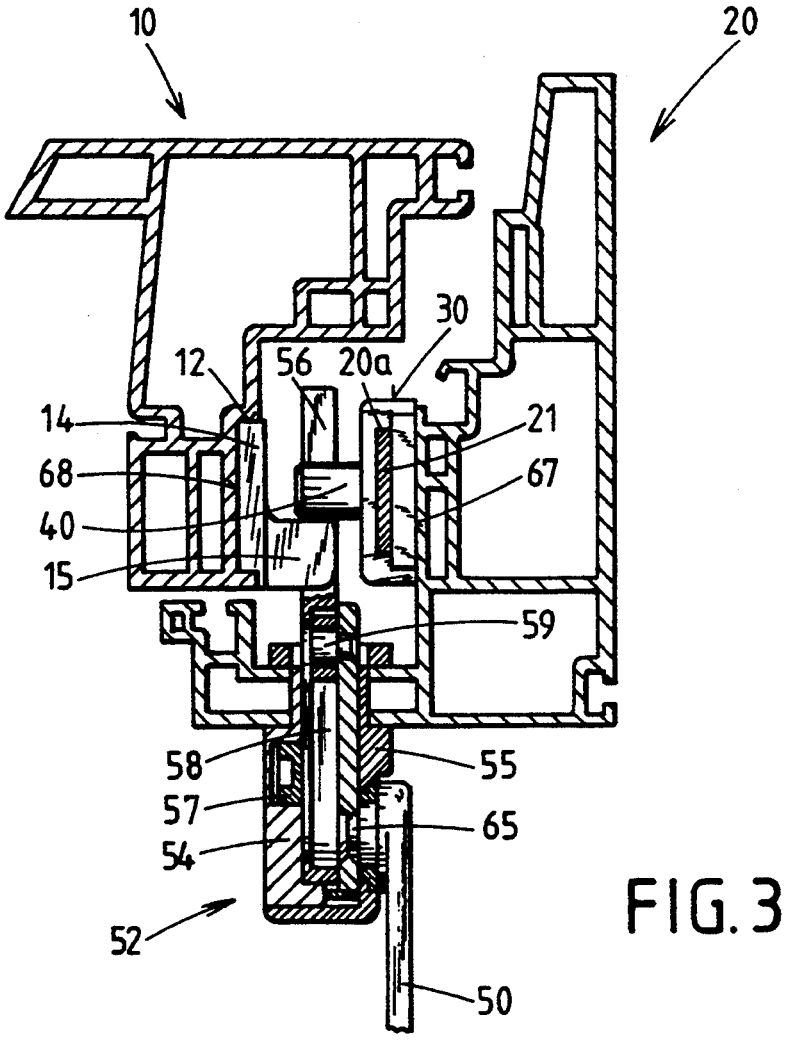
FIG. 3 is an enlarged transverse sectional view of the first and second components in closed position of the second component.

The presently preferred cross-sectional outlines of the frame 20 and sash 10 are shown in FIG. 3; these parts can be mass-produced in an extruder and can consist of aluminum or another metallic material, e.g., another light metal. The positions of the pins 40, carrier 21 and device 52 on the one hand, and of the retainers 12 on the other hand, can be reversed, i.e., the sash 10 can carry the parts 21, 40 and 52, and the frame 20 then carries the retainers 12.

FIGS. 1*a* and 1*b* show the preassembled units 11 and 30 next to (rather than in positions of overlap with) each other. The reason is that the frame 20 and the sash 10 would overlie and conceal certain parts if the components 10, 20 were shown in their actual positions corresponding to those shown in FIG. 3, i.e., with the sash 10 in closed position relative to the frame 20.

The details of the carrier 21 and of the pins 40 thereon are shown in FIGS. 1*a*, 1*b*, 4, 5, 8 and 9. This carrier includes successive sections or unit lengths of identical design each of which has a hole or bore 22 (hereinafter called socket) for a portion of a pin 40. The distance between the centers of two neighboring sockets 22 is shown at 23. Two neighboring sockets 22 flank a pair of elongated slots 24, and such slots are mirror images of each other with reference to a plane which is normal to the plane of the carrier 21 and is located midway between the respective sockets 22. The slots 24 of each pair of such slots have identical lengths (shown in FIG. 4, as at 25) as measured in the longitudinal direction of the carrier 21. Those end portions (26) of the slots 24 which are immediately adjacent the nearest sockets 22 are wider than the remaining major portions of such slots. Accordingly, and as can be best seen in FIG. 4, each of the slots 24 has a substantially T-shaped outline. It is also possible to provide each unit length (23) of the carrier 21 with two slots each of which has a substantially L-shaped outline.

The carrier 21 is further provided with a number of spaced-apart bores or holes 27 substantially midway between a pair of neighboring slots 24. The diameters of the bores or holes 27 are smaller than those of the sockets 22.

The unit 30 (including the frame 20, the carrier 21, the device 52, the pins 40 and a series of spaced-apart guides 33) can be assembled prior to attachment of such unit to the unit 10 (including the sash 10 and the retainers 12). The carrier 21 can be obtained by severing a length of a continuously extruded elongated flat strip-shaped blank from a continuously running web so that the thus obtained carrier 21 can accept a desired number of pins 40, one for each retainer 12 on the sash 10.

Figure 8:
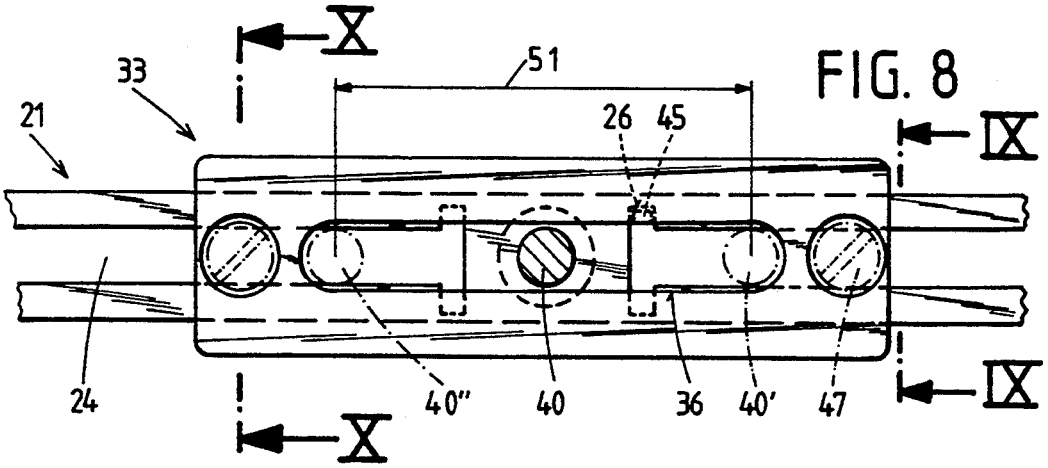
FIG. 8 is an enlarged view of a detail in the structure of FIG. 1*a* as seen in the direction of arrows from the line VIII—VIII in FIG. 9.
Figure 9:
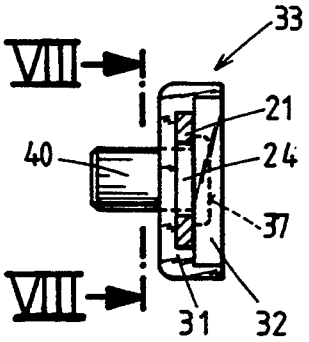
FIG. 9 is a transverse sectional view as seen in the direction of arrows from the line IX—IX in FIG. 8.
Figure 10:
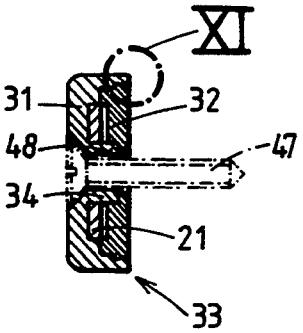
FIG. 10 is a sectional view as seen in the direction of arrows from the line X—X in FIG. 8.
Figure 11:
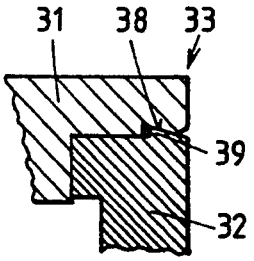
FIG. 11 is an enlarged view of the detail within the phantom-line circle XI in FIG. 10.

The presently preferred configuration and mode of using of the guides 33 are illustrated in FIGS. 1*a*, 1*b* and 5 to 11. Each guide 33 comprises two elongated complementary sections or shells 31, 32 which together define an elongated passage for a portion of the carrier 21, i.e., each guide 33 can be said to constitute a housing or casing for a certain length of the carrier 21. The latter has an elongated rectangular cross-sectional outline (FIGS. 9 and 10). The shell or section 31 overlies the exposed (front) side of the carrier 21 (see FIG. 5), and the shell or section 32 overlies the concealed (rear) side 29 of the carrier 21 behind (i.e., in alignment with) the section 31. The end portions of each shell 31 are provided with male centering members 34 extending into complementary centering members 35 in the end portions of the adjacent section 32. The centering members 34 are hollow and can be provided with internal threads to accept the shanks of fasteners 47 in the form of bolts or screws (FIGS. 8 and 10) serving to fixedly secure the sections 31, 32 of the respective guide 33 to each other. Each male centering member 34 extends through one slot 24 of the carrier 21 when the latter is properly assembled with the guides 33, i.e., when the carrier is properly (longitudinally movably) secured to the frame 20 so that certain portions of the carrier 21 extend into the groove 20*a*.

Each pin 40 has a T-shaped cross-sectional outline and includes a cylindrical shank 41 (FIG. 5) and a relatively thin collar or rim 42 at one axial end of the shank. The shank 41 is introduced into the respective socket 22 in the direction of arrow 43 (FIG. 5), and the introduction is terminated when the rim 42 abuts the rear side 29 of the carrier 21. The next step of mounting a pin 40 in the carrier 21 includes moving the shell 32 in the direction of arrow 44 (FIG. 5) so that a median portion of the shell 32 overlies the rim 42, and the section 32 is thereupon connected with the section 31 by a pair of fasteners 47 in a manner as shown in FIGS. 8 and 10. The section 31 is provided with an elongated slot 36 for the shank 41 of the respective pin 40 so that such pin can move with the carrier 21 relative to the guides 33 and frame 20. Each section 32 has an elongated recess 37 (FIG. 5) which is sufficiently deep to receive and guide the respective rim 42 and thus permits the carrier 21 to move lengthwise relative to the frame 20 to an extent as determined by the length 46 of the slot 36; such length can match that of the recess 37 in the adjacent section 32. The sections 31, 32 of each guide 33 cooperate to maintain the respective pin 40 in an optimum position for movement with the carrier 21 toward or away from locking engagement with the respective retainer 12. The rim 42 is then confined to reciprocatory movements in the recess 37 of the section 32.

In addition to being separably connected to each other by a pair of threaded fasteners 47, the sections 31, 32 of each guide 33 are preferably maintained in predetermined positions of alignment and overlap with each other. This can be seen in FIGS. 10 and 11 which show that at least one longitudinally extending marginal portion of the section 32 is provided with a continuous or interrupted male detent 39 extending into a complementary female detent 38 of the section 31. The illustrated female detent 38 is an undercut groove which can extend the full length of the section 31. The male detent 39 can comprise a single elongated rib extending the full length of the section 32, or such male detent can comprise a small number of relatively short ribs, e.g., two ribs at the two ends of the section 32. Each male detent 39 can have a sawtooth profile.

The device 52 for moving the carrier 21 relative to the guides 33 includes a handle 50 (FIGS. 2 and 3) which is preferably mounted for angular movement about an axis normal to the plane of the carrier 21 and extending transversely of the frame 20. The device 52 determines the extent of movement of the carrier 21 between its first and second end positions; at any rate, the distance between the two end positions of the carrier 21 cannot exceed the length 46 of the slot 36 in the section 31 of a guide 33. The same applies for the distance 25, i.e., such distance (between the ends of a slot 24) at least matches the actual length of movement of the carrier 21 between its two end positions. One end position of the pin 40 in the right-hand portion of FIG. 1*a* is shown at 40' and the other end position of such pin is indicated at 40''. The distance between the axis of the pin 40 in the end position 40' and the axis of the same pin in the end position 40'' is indicated at 51 (FIGS. 1*a* and 8); this distance denotes the axial extent of longitudinal movement of the carrier 21 between its two end positions.

When the assembly of the unit 30 is completed, the guides 33 are disposed in predetermined positions relative to each other (as seen in the longitudinal direction of the carrier 21 on the frame 20). The arrangement is preferably such that the assembly of carrier 21, its pins 40 and the guides 33 is provided with means for temporarily maintaining the carrier 21 in a predetermined position relative to the guides 33 even before such parts are assembled with the frame 20 to form the unit 30. In other words, the improved mechanism can be provided with means for locating the guides 33 in predetermined positions relative to each other and relative to the carrier 21 even before the sections 31, 32 of each guide 33 are actually affixed to the frame 20. Such locating means comprises locating pins or studs 45 (FIGS. 6 and 8) which are provided on the section 31 of each guide 33 and extend into the end portion 26 of the adjoining slot 24 in the carrier 21. When a stud 45 extends into the adjacent portion 46 of a slot 24, the pin 40 is located exactly midway between its end positions 40' and 40''. Such central position of one of the pins 40 is shown in FIG. 8 by solid lines; FIG. 8 further shows that the stud 45 then extends into the adjacent end portion 26 of a slot 24. This positively locates the constituents of the preassembled unit 30 relative to each other, i.e., the guides 33 can be mounted in the frame 20 in predetermined positions relative to one another. Such mounting is carried out by resorting to the aforementioned screws 47 or analogous fasteners. The sections 31 of the guides 33 are provided with recesses 48 (FIGS. 7 and 10) for the heads of the fasteners 47. FIGS. 1*a* and 1*b* show a series of guides 33 in their final positions relative to each other and relative to the frame 20.

The preassembled unit 30 of FIGS. 1*a* and 1*b* comprises a total of seven guides including the guide numbered 30 at one side of the motion receiving pin 70 and guides numbered 33*a*, 33*b*, 33*c*, 33*d*, 33*e*, 33*f* at the other side of the pin 70. The pins 45 locate the guides 33–33*f* in predetermined positions relative to each other as well as relative to the carrier 21 so that the guides are ready to be affixed to the frame 20 by resorting to the fasteners 47. Once the installation of the guides in the frame 20 is completed, the handle 50 can be pivoted to move the carrier 21 lengthwise through the medium of the pin 70 in one of the two directions indicated by a double-headed arrow 49. The initial displacement of the carrier 21 relative to the frame 20 results in destruction of the locating pins 45, i.e., such pins are sheared off by the surfaces bounding the end portions 26 of the respective slots 24. This releases the pin numbered 40 for movement between the end positions 40' and 40'', the pin numbered 40*a* for movement between the end positions 40*a'*, 40*a''*, and the pins numbered 40*b*, 40*c*, 40*d*, 40*e*, 40*f* for movement between the end positions 40*b'* and 40*b''*, 40*c'* and 40*c''*, 40*d'* and 40*d''*, 40*e'* and 40*e''*, and 40*f*, 40*f''*, respectively. When properly mounted on the frame 20, the pins 40–40*f* can be moved into and from locking engagement with locking elements 15–15*f* forming part of the detent members 12–12*f*, respectively. The locking elements 15–15*f* comprise pairs of ramps 16 which facilitate engagement of such locking elements with the respective pins 40–40*f* when the handle 50 is pivoted in a direction to move the pins 40–40*f* to their locking positions subsequent to movement of the sash 10 to a closed position (FIG. 3) relative to the frame 20. The locking elements 15–15*f* are provided on elongated strip-shaped holders 14 which are bolted, riveted, screwed or otherwise secured to the sash 10. Each of the locking elements 15–15*f* is provided with two mirror symmetrical ramps 16; this is desirable because such locking elements (i.e., such holders 14) can be used at either side of the motion receiving pin 70. The line 18 denotes in FIG. 1*a* a median position of the handle 50 forming part of the moving device 52, and the pins 40*a*–40*f* are located at one side of the line 18. The pin 40 is located at the other side of the line 18 and the characters 62*a* to 62*f* respectively denote the distances of the pins 40*a*–40*f* (in the end positions 40*a'* to 40*f'* of such pins) from the line 18. The detents 12*a*–12*f* are equidistant from each other (note the distances 19), and each distance 19 exceeds the aforementioned distance 23 between neighboring pins 40*a*–40*f* (and more specifically between the centers of neighboring sockets 22 in the carrier 21). The guides 33*a*–33*f* of FIGS. 1*a* and 1*b* are located at one side of the line 18, and the guide 33 is located at the other side of such line.

Each of the pins 40–40*f* cooperates with the respective detent (12–12*f*) to constitute therewith a locking unit 60, 60*a*, 60*b*, 60*c*, 60*d*, 60*e*, 60*f*, respectively.

The sash 10 is free to move relative to the frame 20 between an open and a closed position (the closed position is shown in FIG. 3) when the pins 40–40*f* are caused to assume the end positions 40–40*f'*, respectively. The sash 10 can be mounted for pivotal movement between the open and closed positions. When in the end positions 40'–40*f'*, the pins 40–40*f* are disposed at different distances (shown in FIGS. 1*a* and 1*b*, as at 61, 61*a*, 61*b*, 61*c*, 61*d*, 61*e*, 61*f*) from the adjacent ramps 16 of the respective locking elements 15–15*f*. The distance 61 is less than the distance 61*a*, the distance 61*a*, is less than the distance 61*b*, and so forth. The distances 62*a*–62*f* also increase in a direction away from the line 18, i.e., the distance 62*a* equals 23 plus 61*a*, the distance 62*b* equals 62*a* plus 23 plus 62*b*, and so on. Thus, the distances of neighboring pins 40*b* to 40*f* from each other are not whole multiples of the distance of the pin 40*a* from the line 18.

If a person decides to pivot the handle 50 in a direction to move all of the pins 40*a*–40*f* from the end positions 40*a'*–40*f'*, i.e., to move the carrier 21 (through the motion receiving pin 70) in a direction to the left, as viewed in FIG. 8, the pin 40*a* is first to engage the corresponding locking element 15*a* because the distance 61*a* is less than the distance 61*b*, 61*c*, 61*d*, 61*e* or 61*f*. Such engagement involves a movement of the pin 40*a* along the adjacent ramp 16 of the locking element 15*a* so that the sash portion carrying the pin 40*a* is pulled toward the fully closed position relative to the adjacent portion of the frame 20. If the sash 10 is relatively stiff, a movement of the sash portion carrying the pin 40*a* toward the adjacent portion of the frame 20 involves at least some (even so slight) movement of the sash portion carrying the pin 40*b* toward the adjacent portion of the frame 20. Otherwise stated, while moving along one ramp 16 of the locking element 15*a*, the pin 40*a* (which is in the process of moving away from the end position 40*a'*) ensures that the pin 40*b* is more likely to properly engage the corresponding locking element 15b in response to further movement of the handle 50 in a direction to move the pins 40a–40f away from their respective end positions 40a'–40f'.

If the person in charge continues to move the handle 50 in one of the directions indicated by the arrow 49, i.e., in a direction to move the pins 40a–40f nearer to the second end positions 40a''–40f'', the pin 40b reaches and slides along the adjacent ramp 16 of the locking element 15b while the pin 40a slides along the locking element 15a in a direction toward the left-hand ramp 16 of the locking element 15a (as viewed in FIG. 1a). This can entail some additional movement of the sash portion carrying the pin 40a toward the adjacent portion of the frame 20, i.e., the pin 40a cooperates with the locking element 15a to ensure that the corresponding portion of the sash 10 assumes a fully closed position. At the same time, the pin 40b slides along the adjacent ramp 16 of the locking element 15b, and proper engagement of the pin 40b with such ramp 16 is not only likely but practically certain because, if the sash portion carrying the pin 40b was not fully closed at the time the pins 40a–40f have started to leave their end positions 40a'–40f', such sash portion is much more likely to be in closed position due to engagement of the pin 40a with the locking element 15a. In other words, even a distorted sash 10 is highly likely to be properly locked to the frame 20 (or an undistorted sash 10 is more likely to be properly locked to a distorted frame 20) if the pins 40a–40f move into engagement with the respective locking elements 15a–15f one after the other rather than simultaneously as in conventional locking/unlocking mechanisms.

Further movement of the carrier 21 in a direction to move the pins 40a–40f away from the end positions 40a'–40f' results in engagement of the pin 40c with the adjacent ramp 16 of the locking element 15c, and such engagement is not only likely but practically certain because, if the sash portion carrying the pin 40c was not fully closed, such closing takes place in response to movement of the pin 40b from the nearer ramp 16 toward the raised median portion of the locking element 15b. It will be seen that the pins 40a–40f cooperate with the respective locking elements 15a–15f to perform upon the sash 10 a stepwise straightening action so that successive pins 40b–40f are more likely and practically certain to assume proper positions for engagement with the confronting ramps 16 of the respective locking elements 15b–15f in response to immediately preceding engagement of the pins 40a–40e with the respective locking elements 15a–15f.

The same procedure is repeated again and again as the carrier 21 continues to move the pins 40a–40f toward the end positions 40a''–40f'', i.e., the pin 40d engages the locking element 15d, the pin thereupon engages the locking element 15e, and the pin 40f thereafter engages the locking element 15f. The number of pins 40 can be increased or reduced, depending on the dimensions of the sash 10, on the mutual spacing of pins 40 on the carrier 21 and/or upon the length of the carrier 21.

The pins 40a–40f may but need not reach their respective second end positions 40a''–40f''; this depends on the extent of lengthwise movement of the carrier 21 which is necessary to ensure that the pin (40f) which is most distant from the line 18 properly engages the adjacent locking element (15f) to thus ensure that the sash portion carrying the pin 40f is fully closed and is also locked to the adjacent portion of the frame 20.

The intervals between engagement of successive pins 40a–40f with the corresponding locking elements 15a–15f can be very short, depending upon the mutual spacing of the detents 12a–12f and on the speed of movement of the carrier 21 from the starting position corresponding to end positions 40a'–40f' of the respective pins. The extent of movement of the carrier 21 (note the distance 51 in FIG. 8) from the starting position to the position in which the pins 40a–40f respectively assume the end positions 40a''–40f'' should suffice to ensure that each of these pins engages the raised median portion of the respective locking element 15a–15f not later than when the movement of the carrier 21 is terminated because the handle 50 cannot be pivoted any longer in a direction to move the pins 40a–40f away from the line 18 and/or because the carrier 21 is arrested for any other reason. The maximum extent of pivotal movement of the handle 50 in a direction to lock the sash 10 to the frame 20 will determine the number of pins, i.e., the number of locking units 60, 60a . . . 60f.

Figure 2:
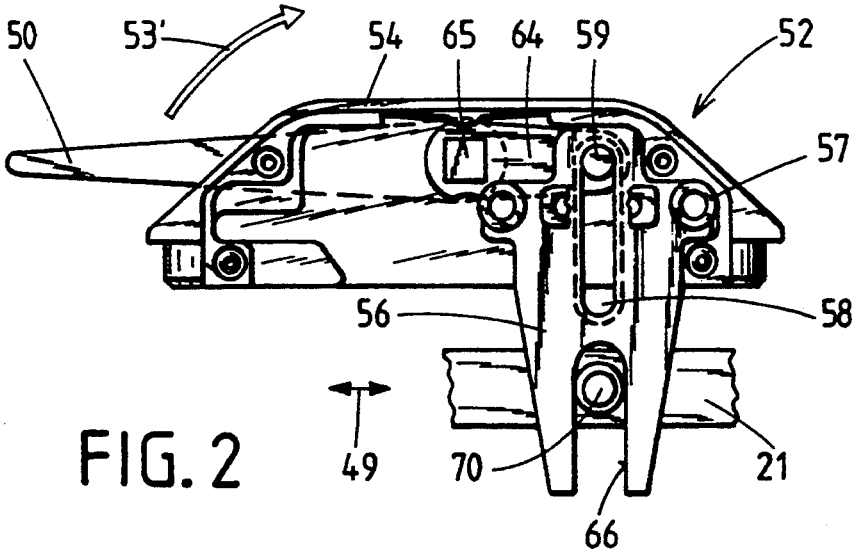
FIG. 2 is an enlarged view of the device which is used to move the carrier for the projections of the second locking assembly relative to the corresponding retainers of the first locking assembly.

It is not absolutely necessary to construct the mechanism of the present invention in such a way that the distance of neighboring pins 40 invariably increases from the line 18 in one of the directions indicated by the double-headed arrow 49. For example, one or more pairs of neighboring pins can be equidistant from each other, as long as the mutual spacing of pins of at least one such pair exceeds the mutual spacing of pins forming another pair. In other words, it is possible to construct the improved mechanism in such a way that at least two pins 40 will simultaneously engage the corresponding locking elements 15 as long as at least one of the pins engages the corresponding locking element with at least some delay. Such modified design will be selected if the number of pins 40 is very large. For example, the arrangement can be such that two pins 40 simultaneously engage the nearer ramps 16 of the respective locking elements 15 in response to advancement of the carrier 21 through a first distance, that two pins thereupon engage the corresponding locking elements 15 with at least some delay and that, if necessary, two additional pins thereupon engage the corresponding locking elements with at least some delay, and so forth. It has been found that the just described modification of the mechanism which is shown in FIGS. 1a and 1b can be resorted to with particular advantage if the moving device 52 is constructed and assembled in a manner as shown in FIGS. 2 and 3.

The mechanism of FIGS. 1a and 1b is constructed and assembled in such a way that the distance 23 between the pins 40a and 40b, 40b and 40c, etc. is constant. Furthermore, the difference 63 between the distances 61a and 61b is the same as that between the distances 61b and 61c, between 61c and 61d, and so forth. The distance 19 equals the distance between the right-hand edge portions of the locking elements 15a and 15b, between the right-hand edge portions of the locking elements 15b and 15c, and so forth. Each distance 19 equals the distance 23 plus the combined distances 61a and 63 (equaling 61b). The difference 63 will be selected to ensure predictable and reliable positioning of successive pins 40a–40f for engagement with the respective detents 12a–12f in response to movement of the handle 50 from the starting or neutral position toward the position in which the carrier 21 assumes one of its end positions, i.e., in a direction to move the pins 40a–40f toward the end positions 40a''–40f''. Selection of a constant distance 23 and a constant distance 19 simplifies the design of the improved mechanism because the mechanism can employ detents 12a–12f of identical design. However, it is equally possible to select different distances 23 and to increase the distances 61a, 61b, etc. with progressing distance from the line 18. It is then possible to employ detents 12 whose locking elements 15 are provided with ramps 16 and are installed at different distances from each other to account for differences between the distances 61.

The moving device 52 is or can be identical with that described in the aforementioned copending patent application of Dreifert for "Device for locking and unlocking sashes in door- or window frames". As shown in FIGS. 2 and 3, the handle 50 is a lever which is pivotable (note the double-headed arrow 53 in FIG. 1a) at 65 about an axis extending at right angles to the plane of FIG. 2 and located in the plane of FIG. 3. The mounting of the handle 50 is such that it can be pivoted through an angle of at least close to 180°, namely between the end position shown in FIG. 2, through the intermediate position shown in FIG. 1a by broken lines and in FIG. 3 by solid lines, and to a second end position at an angle of at least close to 90° from the position of FIG. 1a. The handle 50 is connected with a crank 64 in such a way that the latter shares the angular movements of the handle about the axis of the pin 65, and the crank has a follower 59 extending into an elongated slot 58 of a plate-like member 56 having a second slot 66 for reception of the motion receiving pin 70 on the carrier 21. The crank 65 is mounted in a housing having two sections 54, 55. The plate member 56 has a follower 57 which is guided in a slot provided therefor in the internal surface of the housing section 54. The handle 50 is located at the exposed side of the section 55 and can be pivoted by hand. The arrow 53' denotes in FIG. 2 the direction in which the handle 50 must be pivoted toward the intermediate position of FIG. 1a or FIG. 3 and thereupon to the other end position. The housing including the sections 54 and 55 is mounted at that side of the frame 20 which confronts the sash 10 when the latter is pivoted to the closed position of FIG. 3. The frame 20 can constitute a profiled body (FIG. 3) which is formed in an extruding or other suitable machine. The same applies for the sash 10.

The holders 14 for the detents 12 are mounted at that side of the sash 10 which faces the frame 20 when the sash assumes the closed position of FIG. 3. The latter shows the handle 50 in the intermediate position corresponding to that shown in FIG. 1a; the handle assumes such intermediate position before the locating pins 45 (FIGS. 6 and 8) are destroyed.

If the handle 50 is pivoted relative to the housing including the sections 54 and 55, the follower 59 of the crank 64 moves along the slot 58 of the plate member 56 and causes the plate member to move its follower 57 along the aforementioned groove in the internal surface of the housing section 54 whereby the surface bounding the slot 66 moves the pin 70 and the carrier 21 relative to the guides 33 so that the pins 40 perform the aforediscussed movements relative to the respective detents 12.

The pin 70 is received in one of the sockets 22 (between the guide numbered 33 and the guide numbered 33a in FIG. 1a).

The ability of the handle 50 to pivot along an arc of at least close to 180° is desirable and advantageous because this enables the carrier 21 to cover a substantial distance in order to move the pins 40a–40f between the end positions 40a'–40f' and 40a''–40f''. This, in turn, renders it possible to employ (if necessary) a large number of pins (such as 40a–40f) each of which can engage the corresponding detent (such as 12a–12f) during a different stage of movement of the carrier 21 relative to the sash 10 and relative to the frame 20.

In order to secure the carrier 21 in the one and/or the other end position, the handle 50 can be pivoted beyond a so-called dead-center position to thus prevent unintentional (e.g., accidental) movement of the carrier 21 from the selected end position. All this is fully described in the copending patent application of Dreifert. Locking of the carrier 21 in the position in which the pins 40a–40f assume the end positions 40a''–40f'' is particularly desirable because this prevents accidental unlocking of the sash 10 from the frame 20.

The device 52 of FIGS. 2 and 3 can be modified in a number of ways, for example, as described in the copending patent application of Dreifert. Thus, the crank 64 can be indirectly connected to the plate member 56 by a link; one end portion of the link is then articulately connected to the plate member 56 and the other end portion of such link is articulately connected to the crank 64. The link and the crank 64 then constitute a toggle joint.

Figures 4, 5:
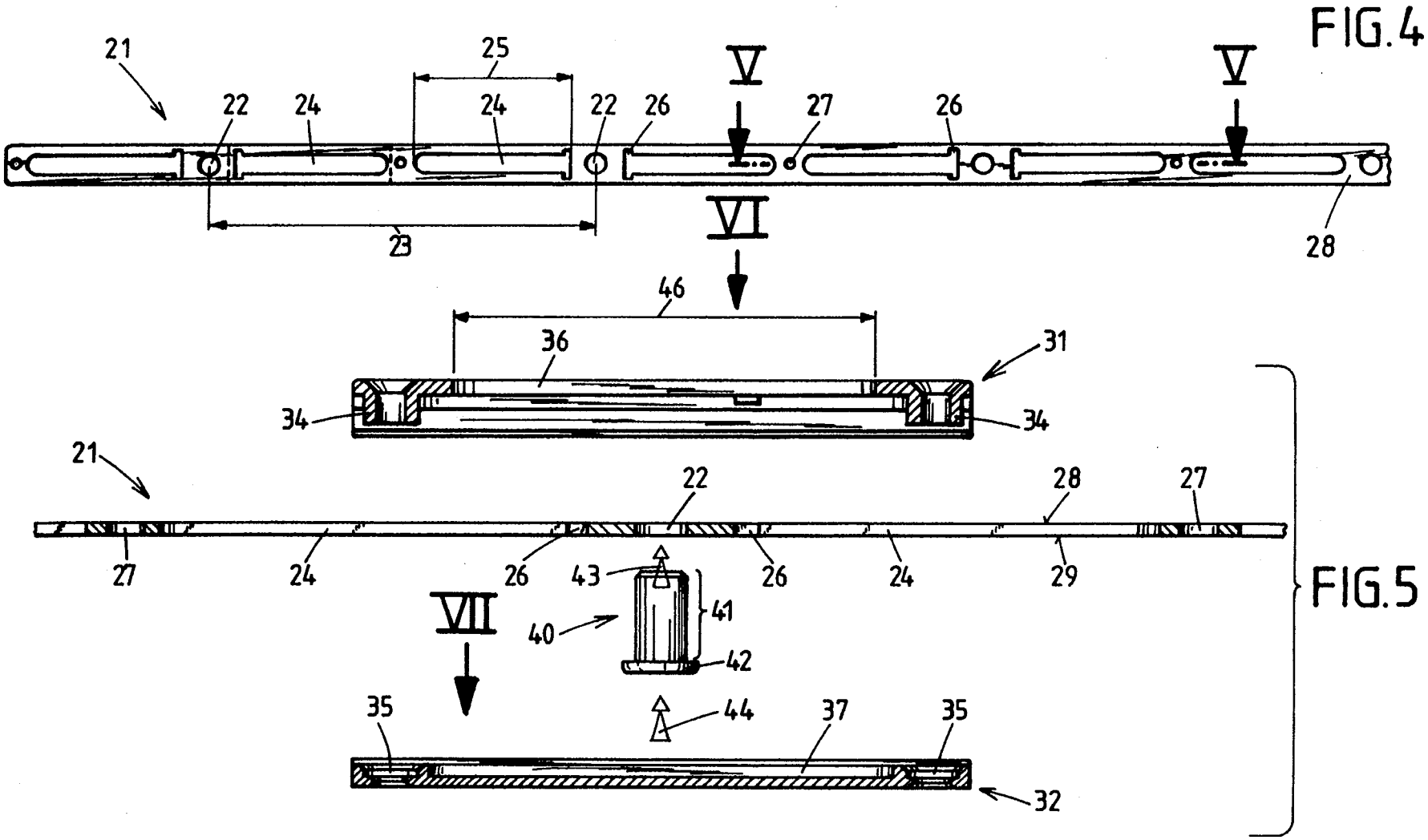
FIG. 4 is an enlarged fragmentary front elevational view of the carrier which is utilized in the mechanism of FIGS. 1*a* to 3.
FIG. 5 is an enlarged fragmentary sectional view as seen in the direction of arrows from the line V—V in FIG. 4, and further showing the sections of a discrete guide for the carrier and a projection forming part of the first locking assembly.
Figure 6:
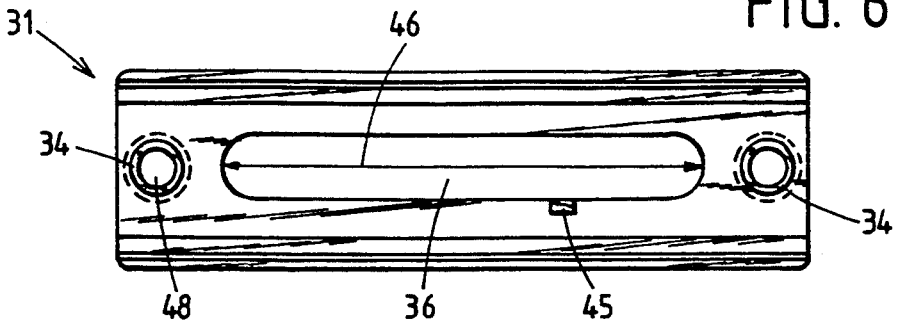
FIG. 6 is a plan view of one section of the guide, substantially as seen in the direction of arrow VI in FIG. 5.
Figure 7:
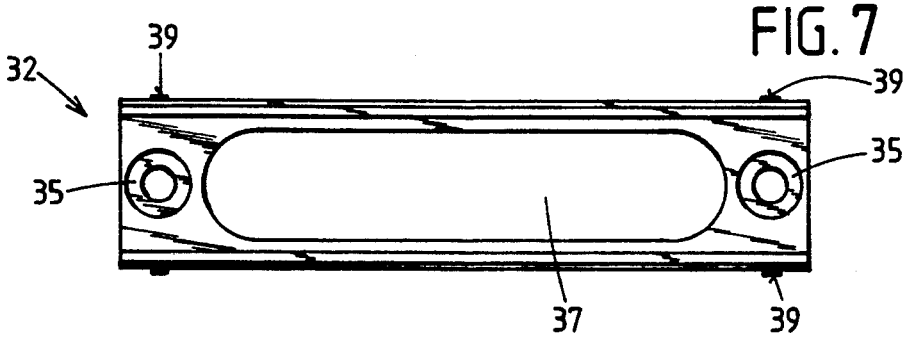
FIG. 7 is a plan view of the other section of the guide, substantially as seen in the direction of arrow VII in FIG. 5.
Figure 12:
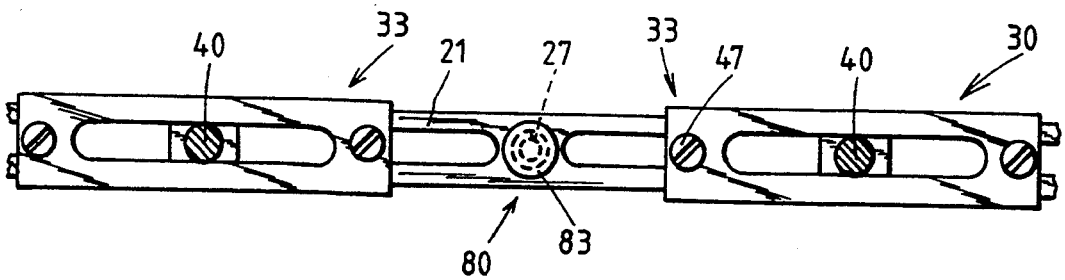
FIG. 12 is a front elevational view of a mechanism which embodies the structure of FIGS. 1*a* to 11 and is further provided with a safety device which can lock the movable component in the closed position.
Figure 13:
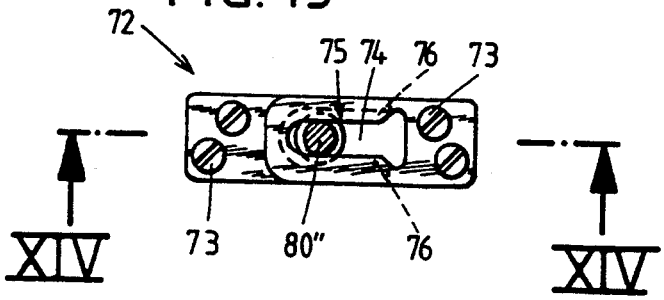
FIG. 13 is a plan view of the safety device as seen in the direction of arrow from the line XIII—XIII in FIG. 14.
Figure 14:
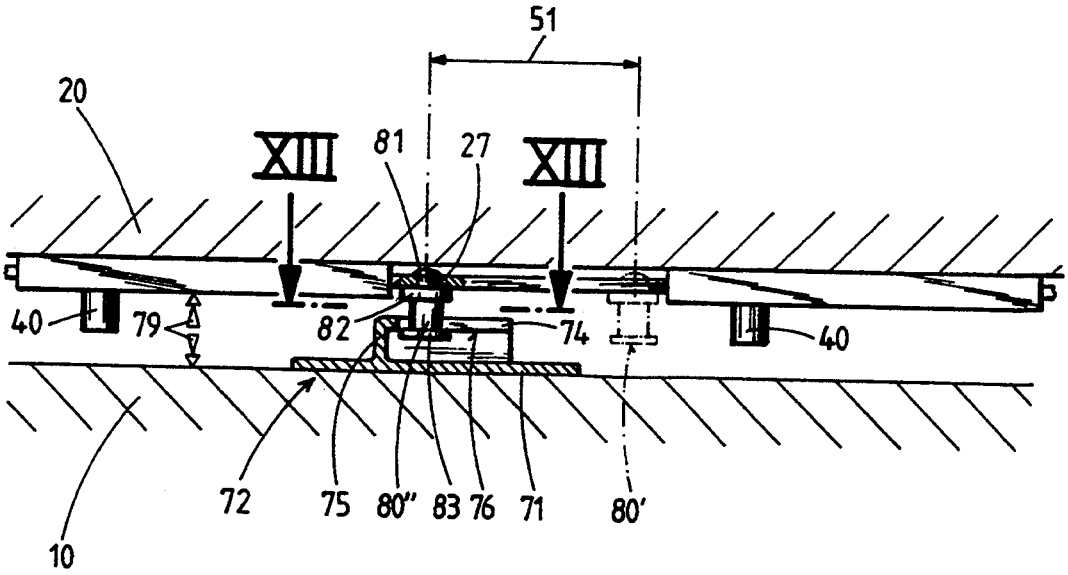
FIG. 14 shows the mechanism of FIGS. 12 and 13 as seen in the direction of arrows from the line XIV—XIV in FIG. 13.

FIGS. 12 to 14 illustrate a portion of a mechanism which embodies the features of the mechanism of FIGS. 1a–1b and is further provided with means for locking or securing the pins 40 (only two of these pins can be seen in FIG. 12) in their end positions 40'', i.e., the pins 40 cannot be accidentally disengaged from the respective locking elements 15 (not shown) and the respective detents 12 (each of which comprises a locking element 15). The safety feature is desirable and advantageous because this frustrates a would-be burglar even if the unauthorized person employs burglars' tools. The locking or securing means includes a protuberance here shown as a pin 80 which, in the embodiment of FIGS. 12–14, is mounted on or is otherwise directly affixed to the carrier 21. The protuberance or pin 80 can be installed in one of the aforementioned bores or holes 27 in the carrier 21. It will be recalled (and this is shown in FIG. 4) that the bores or holes 27 alternate with the sockets 22 of the carrier 21. The shank 81 of the pin 80 can be introduced into a selected bore or hole 27 and the head of the pin 80 is thereupon upset to constitute a rivet. FIG. 14 shows that the pin 80 resembles a mushroom and, in addition to the shank 81, comprises a collar 82 adjacent the shank 81 and a cap or head 83 at the other end of the pin. The latter is installed in a bore or hole 27 of the carrier 21 between two neighboring guides 33. As can be seen in FIG. 12 (which shows the carrier 21 in a position ready for installation in the frame 20), the pin 80 is located in a neutral position between the end positions 80' and 80''. The distance between the axis of the pin 80 in the position 80' and the axis of the same pin 80 in the position 80'' is shown at 51. The pin 80 is movably mounted on the frame 20 and is shown adjacent a securing element 72 which is provided on the sash 10 and is ready to be engaged by the pin 80 in the closed position of the sash.

The securing element 72 comprises a plate-like base 71 which is affixed to the sash 10 by pairs of screws 73 or other suitable fasteners. A raised portion or pocket 75 of the base 71 has an elongated slot 74 whose open end faces the pin 80 when the latter assumes the end position 80'. When in the position 80', the pin 80 is located outside of the pocket 75, i.e., the sash 10 is not locked and is not secured to the frame 20 because a mere pull upon the sash can cause the latter to pivot or to otherwise move relative to the frame 20. The pin 80 assumes the end position 80' when the pins **40–40*f* assume the end positions 40'–40*f'*, respectively, i.e., the sash 10 is free to move relative to the frame 20 between a fully closed position (FIG. 3) and a fully open position in which the detents 12–12*f* are remote from and cannot be engaged by the respective pins 40–40*f* in response to pivoting of the handle 50. If the handle 50 is pivoted to move the pins 40–40*f* to the positions 40''–40*f''*, the pin 80 moves to the position 80'' (shown in FIG. 14 by solid lines) in which its head 83 engages the internal surface 76 of the pocket 75 adjacent the slot 74 and thus secures (locks) the sash 10 to the frame 20, not only as a result of engagement of the pins 40*a*–40*f* with the respective detents 12*a*–12*f* but also as a result of engagement of the pin 80 with the base 71 of the securing element 72**.

If a burglar attempts to pry open the sash 10 by inserting a suitable tool between the components 10, 20 and by thereupon exerting a spreading or separating force in directions which are indicated in FIG. 14 by arrows 79, such separation of the sash from the frame is opposed by the pins **40*a*–40*f* in cooperation with the respective detents 12*a*–12*f* as well as by the safety pin 80 in cooperation with the device 72. It is clear that the carrier 21 can be provided with two or more pins 80 and that the sash 10 then carries an equal number of safety devices 72**.

Figure 15:
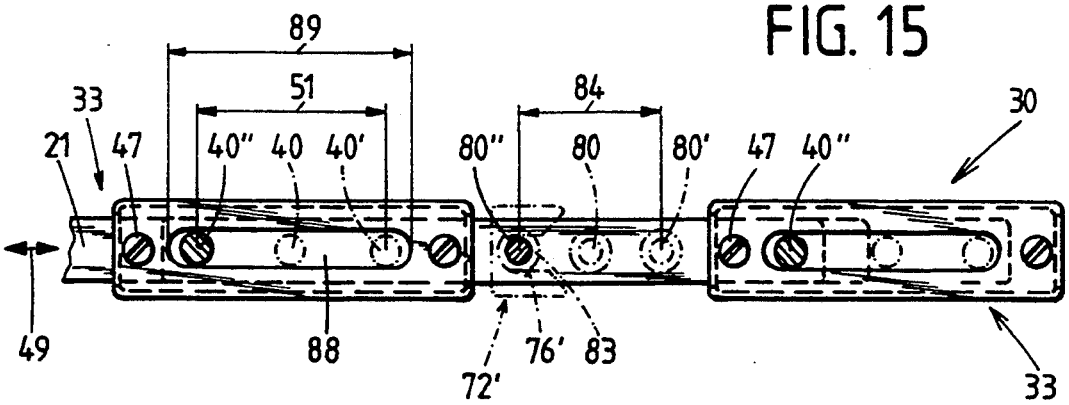
FIG. 15 is a sectional view as seen in the direction of arrows from the line XV—XV in FIG. 16 and shows a portion of the improved mechanism and a safety device constituting a modification of the device shown in FIGS. 12 to 14.

FIGS. 15 through **19*d* illustrate a mechanism which is equipped with a safety device departing from that including the pin 80 and the element 82 of FIGS. 12–14. This modified safety device can be put to use with particular advantage if it is to be mounted on or in an installed door- or window frame. The safety pin 80 is indirectly connected with the carrier 21 by a coupling of the type shown in FIGS. 19*a* to 19*d*. Such coupling renders it possible to move the pin 80 between the two end positions 80' and 80'' through a relatively short distance 84. The securing element 72' which cooperates with the protuberance or pin 80 is mounted on the sash 10 and has a pocket with a relatively short through slot (the length of this slot is shown at 77) having an internal surface 76'**.

Figure 16:
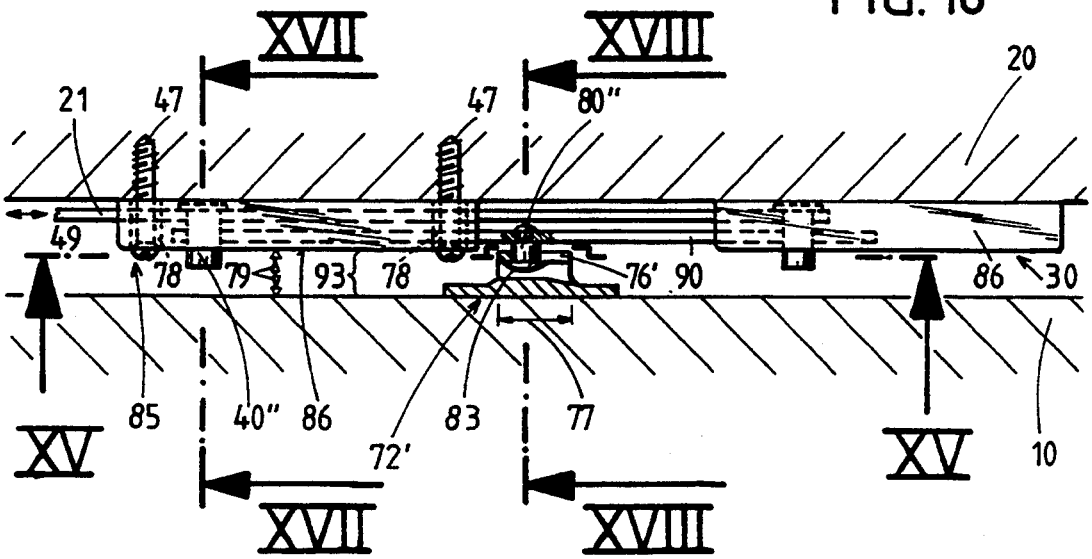
FIG. 16 is a partially plan and partly longitudinal sectional view of the structure which is shown in FIG. 15.

The coupling between the pin 80 and the carrier 21 includes a link 90 which extends across the space between two neighboring guides 33 for the carrier 21. This link is secured to the carrier 21 by two neighboring pins 40 extending through elongated closed slots 91 in the end portions of the link 90. The pins 40 extend into the adjacent slots 91 in one of their two end positions (40', 40''). The link 90 is parallel to the carrier 21 and is guided by discrete guiding elements 85 in the frame 20. FIGS. 15, 16 and **19*a* show that the pins 40 can enter the adjacent slots 91 of the link 90 when they assume the end positions 40''. The guiding elements 85 can constitute portions of the guides 33 and can further include additional parts 86 in the form of shells or covers on the frame 20. Each of the two illustrated guides 33 cooperates with the adjacent cover or shell 86 to define a channel 87 for a portion of the link 90. The latter is confined to reciprocatory movements in directions which are determined by the channel 87**.

Figure 17:
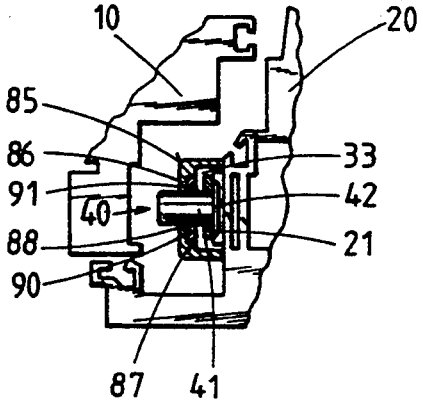
FIG. 17 is a transverse sectional view substantially as seen in the direction of arrows from the line XVII—XVII in FIG. 16.

As can be seen in FIG. 17, the cylindrical shank 41 of the pin 40 which is shown therein extends through the respective slot 91 of the link 90 and also through and beyond an elongated slot 88 in the cover 86. The length of the slot 88 is shown in FIG. 15, as at 89, and such length suffices to ensure that the carrier 21 can perform movements through the distance 51, i.e., the distance between the axes of a pin 40 between its end positions 40' and 40''. The cover 86 can be affixed to the adjacent guide 33 in any one of a number of different ways, for example, by resorting to the aforementioned fasteners 47 which are used to secure the sections 31, 32 of the guides 33 to the frame 20. Alternatively or in addition to the fasteners 47, the guides 33 and the adjacent covers 86 can be provided with complementary male and female detents (not shown). The reference characters 78 denote in FIG. 16 those locations where the heads of the fasteners 47 engage the respective covers 86. For example, the covers 86 can be provided with holes (78) for portions of the shanks of the fasteners 47, and the heads of such fasteners engage the adjacent sides of the covers 86 when the application of fasteners is completed to thus ensure that the covers 86 are properly located relative to the respective guides 33 and that the guides are reliably secured to the frame 20.

Figure 18:
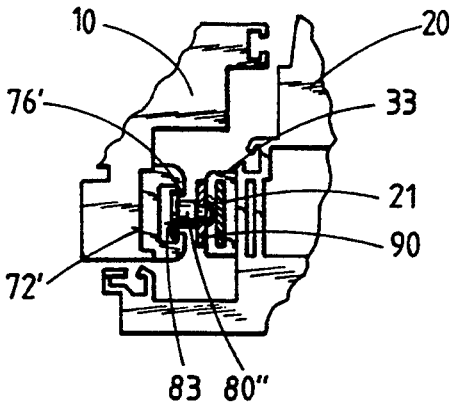
FIG. 18 is a transverse sectional view substantially as seen in the direction of arrows from the line XVIII—XVIII in FIG. 16.

When the pins which are shown in FIGS. 15 and 16 are moved to the end positions 40'' (such positions of the pins 40 are indicated by solid lines), the pin 80 assumes the position 80''. The pin 80 is riveted or otherwise securely affixed to the link 90. The head 83 of the pin 80 then engages the internal surface 76' of the pocket of the securing element 72' (see FIG. 18). Consequently, if an unauthorized person attempts to pry the sash 10 open by applying forces in directions indicated in FIG. 16 by arrows 79, the pin 80 (in the position 80'') cooperates with the securing element 72' to prevent a movement of the sash 10 away from the frame 20. The securing element 72' cooperates with the pin 80 to assist the pins 40 and the retainers 12 (not shown in FIGS. **15–19*d*) in preventing unauthorized movements of the sash 10 relative to the frame 20**.

Figures 19A, 19B, 19C, 19D:
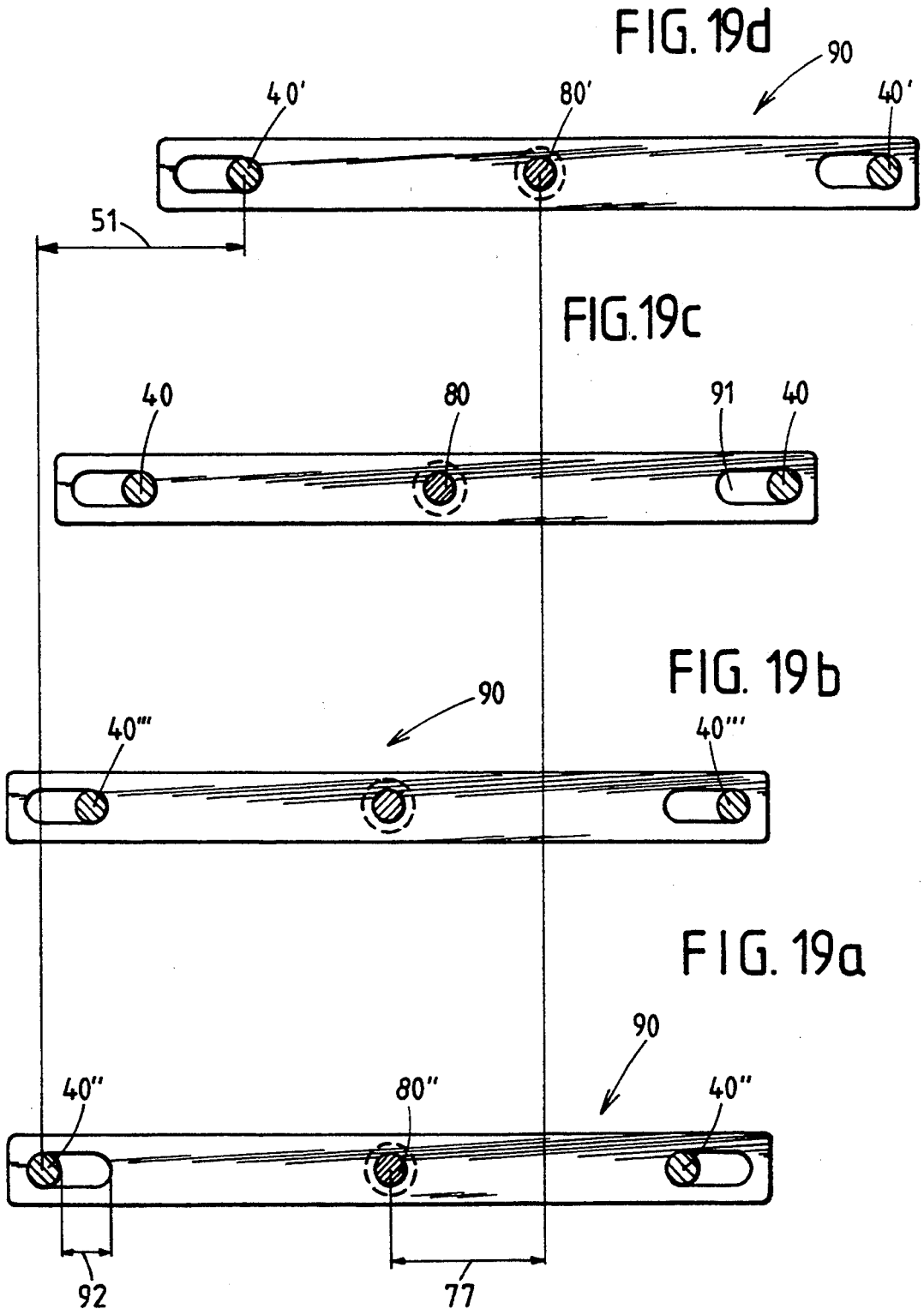
FIGS. 19*a*, 19*b*, 19*c* and 19*d* illustrate four different positions of a link forming part of the safety device which is illustrated in FIGS. 15 to 18.

FIGS. **19*a* to 19*d* illustrate four different positions of the link 90 and pin 80 relative to each other. Thus, when the pin 80 assumes the position shown in FIG. 19*a*, the safety device including the pin 80 and the link 90 is operative to lock the carrier 21 in the closed position, i.e., against movement of the sash 10 with reference to the frame 20. The sash 10 and the carrier 21 can be moved away from each other when the pin 80 assumes the position 80' shown in FIG. 19*d*. If the handle 50 (not shown in FIGS. 15–19) is manipulated to move the carrier 21 in one of the directions indicated by the double-headed arrow 49, the pins 40 first perform so-called idle strokes through a distance 92 (determined by the length of unoccupied portions of the slots 91 in the end portions of the link 90) in directions away from the end positions 40'', and the idle strokes are completed when the pins 40 reach the intermediate positions 40''' shown in FIG. 19*b*. From there on, and assuming that the handle 50 continues to turn in a direction to move the pins 40 away from the end positions 40'', the pins 40 actually entrain the link 90. Prior to reaching the end positions 40' shown in FIG. 19*d*, the pins 40 advance through the second intermediate positions (40) which are shown in FIG. 19*c*. The intermediate positions which are shown in FIG. 19*c* correspond to the aforediscussed assembly or mounting positions and in which the head 83 of the pin 80 is no longer in register with the surface 76' of the relatively short pocket forming part of the securing element 72'. The pin 80 assumes the position 80' shown in FIG. 19*d* when the pins 40 assume the end positions 40'; at such time, the head 83 of the pin 80 is spaced apart from the securing element 72'** so that the device including the parts 72' and 80 does not interfere, in any way whatever, with movements of the carrier 21 and the sash 10 relative to each other.

The provision of the aforementioned idle stroke 92 renders it possible to shorten the distance 84 between the axis of the pin 80 in the end position 80' and the axis of the same pin in the end position 80''. The distance 84 is shorter than the distance 51 (by the length 92 of unoccupied portion of a slot 91). This is desirable and advantageous if the safety device 80, 90 is to be installed in a door or window subsequent to installation of the locking/unlocking mechanism including the carrier 21, pins 40, retainers 12 and the moving device 52. The properly installed link 90 is located at a relatively short distance (shown in FIG. 16, as at 93) from the sash 10 in closed position of the latter. Such relatively short distance 93 suffices for installation of the securing element 72'. If the height of the element 72' were to exceed the distance 93, the covers 86 could interfere with movements of the sash 10. This would prevent installation of the pin 80 with link 90 in the already installed unit 30.

An important advantage of the improved mechanism is that the sash 10 can be automatically moved to its fully closed position in response to actuation of the handle 50 in a direction to engage successive pins 40*a*, 40*b*, 40*c*, . . . on the carrier 21 with successive retainers 12*a*, 12*b*, 12*c*, . . . on the sash 10. The engagement of a preceding pin (e.g., 40*a*) with the respective retainer (12*a*) brings the next-following retainer (12*b*) close to an optimum position for engagement by the oncoming pin (40*b*). As already mentioned above, this results in automatic straightening of the sash 10 and/or of the frame 20 in response to pivoting of the handle 50 to the end position in which all of the pins are in full engagement with the adjacent retainers. Thus, a person wishing to move the sash 10 to closed position and to lock the sash in such closed position is merely required to push the sash against the frame in the region of the handle 50. Once the sash portion which is adjacent the handle 50 assumes the fully closed position, the handle 50 can readily engage the nearest pin (such as 40*a*) with the corresponding retainer (12*a*). From there on, the person in charge of manipulating the handle 50 need no longer push the sash 10 against the frame 20 because the pins 40*b*, 40*c*, . . . ensure proper alignment with the corresponding retainers 12*a*, 12*b*, 12*c*, . . . even if the sash and/or the frame is slightly deformed. Thus, in addition to performing a locking function, the pins 40*a*–40*f* cooperate with the respective retainers 12*a*–12*f* to straighten the component 10 and/or the component 20 in response to pivoting of the handle 50 to the position in which the pins 40*a*–40*f* are located at a maximum distance from the handle 50. Thus, it is possible that the pin 40*f* could not engage the corresponding retainer 12*f* simultaneously with engagement of the pin 40*a* with the retainer 12*a*; however, once the engagement of the pins 40*a*– 40*e* with the respective retainers 12*a*–12*e* is completed, the retainer 12*f* is ready to be engaged by the oncoming pin 40*f*.

Automatic straightening of the sash 10 and/or of the frame 20 in response to pivoting of the handle 50 ensures that the sash is moved into optimal engagement with the frame not later than when the pin 40*f* fully engages the respective retainer 12*f*.

The likelihood of adequately straightening the sash 10 and/or the frame 20 is more pronounced if the carrier 21 supports a relatively large number of closely adjacent pins. The manufacturer can select the spacing between the first and last pins in such a way that a selected length of the sash is compelled to assume a fully closed position by the simple expedient of pivoting the handle 50 all the way from the one to the other end position, i.e., by moving the carrier 21 all the way between its two end positions corresponding to the end positions (such as 40' and 40'') of a pin (such as 40).

The distance which is covered by the carrier 21 during movement between its two end positions will also influence the number of pins and retainers. The aforedescribed moving device 52 can be readily designed to move the carrier 21 through a distance of 48 mm and even more. Such distance suffices to properly align a substantial number of retainers with the oncoming pins. This, in turn, renders it possible to automatically straighten a relatively long portion of the sash 10 and/or frame 20, or to provide a relatively large number of pins rather close to the handle 50 to thus even further reduce the likelihood of improper alignment of the retainers with the oncoming pins as long as the first pin (such as 40*a*) has properly engaged the corresponding retainer (12*a*).

The improved mechanism can be utilized to properly lock a relatively large or a relatively small sash in closed position. This ensures that the sash is moved into sealing engagement with the frame as well as that the mechanism can readily compensate for minor (or even pronounced) tolerances in the making and assembly of a door or window wherein the sash can be locked to the frame in a manner as described above.

Manipulation of the handle 50 does not necessitate the exertion of a large force because each retainer is properly aligned with the oncoming pin not later than when the pin reaches the confronting ramp 16. Of course, the straightening must be carried out by the handle 50; however, the aforedescribed distribution of pins and retainers longitudinally of the carrier 21 ensures that such straightening (if necessary) can be carried out in response to the exertion of a surprisingly small force.

The carrier 21 can be obtained by repeatedly severing a continuous blank which issues from an extruder or another suitable machine. This reduces the cost of making the improved mechanism. The pins 40, 40*a*, . . . need not be of one piece with the carrier 21 (see FIG. 5), i.e., such pins can be introduced into selected sockets 22 and are thereupon confined between the sections 31, 32 of the respective discrete guide 33 which is ready to be affixed to the frame 20. The making of preassembled units 11 and 30 also contributes to simplicity and lower cost of the improved mechanism.

If the pins are equidistant from each other, as seen in the longitudinal direction of the carrier 21, the retainers can also be installed in such a way that they are equally spaced apart from one another. This is desirable and advantageous because the mechanism can employ identical retainers. All that is necessary is to ensure that the distance between neighboring retainers exceeds the distance between neighboring pins. One can employ a template with equidistant graduations to facilitate proper mounting of the retainers on the sash 10. Even though (at a first glance) the relationship of distribution of the pins to the distribution of the retainers appears to be rather complex, first glance, proper distribution of such parts on the carrier 21 and on the sash 10 is actually extremely simple which contributes to lower cost of the mechanism.

A person who wishes to lock the sash 10 in closed position need not waste any time to ascertain whether or not the sash is deformed because, once the pin (40*a*) nearest to the handle 50 has been caused to engage the corresponding retainer (12*a*), the next-following pins will automatically engage the corresponding retainers even if this involves a certain amount of straightening of the sash 10 and/or frame 20.

The securing devices of FIGS. 12 to 19 constitute optional but desirable and advantageous features of the improved mechanism.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A locking mechanism for windows or doors comprising:

a moveable frame;

a fixed frame that selectively lockingly engages with said moveable frame;

a plurality of longitudinal guides each being fixedly attached to said fixed frame at predetermined spaced apart positions, each of said plurality of longitudinal guides includes a front shell and a rear shell which mate together to form a housing;

a driving rod being longitudinally slidably received in said housing of each of said plurality of longitudinal guides, said driving rod having a plurality of sockets at uniform predetermined spaced apart positions;

a plurality of locking pins, each of said locking pins being received in a corresponding one of said sockets and being longitudinally slidably received in said housings of each of said plurality of longitudinal guides;

a plurality of locking detents being fixedly attached to said moveable frame at predetermined substantially constant spaced apart locations, each of said locking detents having a locking element;

means for longitudinally moving said driving rod between a first end position and a second end position such that in said first end position each of said locking pins contacts and engages with said corresponding locking element and said moveable frame is in locking engagement with said fixed frame, and in said second end position each of said locking pins is spaced from said corresponding locking element and said moveable frame is in free disengagement with said fixed frame;

means for temporarily maintaining the longitudinal position of said driving rod with respect to said plurality of longitudinal guides, said temporary position maintaining means includes a stud connected to said longitudinal guides being disposed in a widened portion of a slot in said driving rod;

said driving rod, said plurality of longitudinal guides and said plurality of locking pins being preassembled into an integral unit, said plurality of longitudinal guides having centering members to receive fasteners such that said plurality of longitudinal guides are fixedly attached to said fixed frame while maintaining the desired predetermined spacing of said longitudinal guides and said plurality of sockets.

2. The mechanism of claim 1, wherein said temporary position maintaining means can be overcome by said longitudinal moving means when a handle of the moving means is activated to move the plurality of locking pins between said first end position and said second end position.

3. The mechanism of claim 2, wherein at least one of said widened portion of said slot and said stud is destroyed by shearing when the handle of the integral unit is activated.

4. The mechanism of claim 3, wherein the driving rod has at least one slot in the space between the sockets for the locking pins such that the longitudinal length of the slot is greater than or equal to the length of movement of said driving rod between the first end position and the second end position, and wherein the slots receive said fasteners.

5. The mechanism of claim 4, wherein the widened portion of said slot is disposed at an end of said slot.

6. The mechanism of claim 5, wherein the housing has the shape of a shell whose width matches the cross section of the driving rod, and wherein the front and rear housing shells are affixed to one another by mating connectors.

7. The mechanism of claim 6, wherein the front shell of the housing, has at least one male centering member, which, when assembled, engages the slot of the driving rod and wherein the male centering member serves as a contact point for the fasteners which are anchored in the fixed frame.

8. The mechanism of claim 7, further including a complementary female centering member in the rear shell and wherein, when the housing is assembled, the male centering member engages with the female centering member.

9. The mechanism of claim 8, wherein the housing has a longitudinal slot extending parallel to the driving rod, such that an outer end of the locking pin, which is disposed in the socket of the driving rod, extends out of said housing longitudinal slot, and wherein the longitudinal dimension of the housing longitudinal slot is greater than or equal to the distance between the first end position and the second end position of the driving rod.

10. The mechanism of claim 9, wherein an end of the locking pin which is disposed inside the housing has a head-like collar, with which, together with the driving rod, are longitudinally moveable within the fastened housing.

11. The mechanism of claim 10, wherein the locking pins are inserted into the sockets from the rear side of the driving rod which faces the rear shell, and wherein the locking pins, when assembled, freely extend through the sockets in the driving rod while their head-like collar is captured between the rear side of the driving rod and a bottom wall of the rear shell.

12. The mechanism of claim 11, wherein the bottom wall of the rear shell has a longitudinal recess extending parallel to the driving rod such that the head-like collar of the locking pin executes a sliding motion therein, and wherein the length dimension of the longitudinal recess is greater than or equal to the distance between the first end position and the second end position of the driving rod.

13. The mechanism of claim 12, wherein the locking pins have a T-shaped profile, with a cylindrical body and a rim which is the head-like collar.

14. The mechanism of claim 13, wherein the distances between the adjacent locking pins are less than the distances between the locking detents, and the distances between the locking elements and the locking pins in their free disengaged position, for each locking pair of locking elements and locking pins, are coordinated with one another, such that when the driving rod is moved longitudinally into its locking end position, a free end of the locking element, each of which has a slanted taper, and the respective locking pin, in the individual locking pairs contact one another with a time delay for each respective locking pair and pull the moveable frame from locking pair to locking pair, toward the fixed frame.

15. The mechanism of claim 14, wherein the driving rod has a plurality of securing pins fixed thereto, said securing pins each have a mushroom profile such that their mushroom cap is situated at the free end of the bolt, a plurality of longitudinally grooved securing elements are fixedly attached to said moveable frame, in said first end position of the driving rod, each securing pin engages the longitudinal groove of the respective securing element and thus the mushroom caps grip behind a groove wall of the securing element.

16. The mechanism of claim 15, wherein the driving rod has a plurality of holes disposed at a constant longitudinal distance from one another to receive the securing pin.

17. The mechanism of claim 16, wherein the holes for the securing pins are arranged in alternation with the slots for the locking pins in the driving rod.

18. The mechanism of claim 17, wherein the securing pins are riveted directly on the driving rod.

19. The mechanism of claim 18, wherein the securing pin is coupled subsequently to the driving rod, such that the securing pin can be moved by the driving rod, via the coupling, between two end positions with respect to the position of the respective securing element into a locking position which grips the groove wall of the securing element from behind and a non-locking position where the securing pin is removed from the groove of the securing element.

20. The mechanism of claim 19, wherein the coupling of the securing pin is effected through a coupling link which is disposed parallel to the driving rod, the securing pin being seated on said coupling link.

21. The mechanism of claim 20, wherein the coupling link has slots and the locking pin penetrates at least one of the coupling link slots.

22. The mechanism of claim 21, wherein the coupling link is guided longitudinally through discrete guide elements that are disposed parallel to the driving rod.

23. The mechanism of claim 22, wherein each discrete guide element includes a cover shell, which is fixed to the fixed frame and which guides the driving rod longitudinally, said cover shell, together with the housing, forms a channel for longitudinally guiding the coupling link.

24. The mechanism of claim 22, wherein the discrete guide elements have a plurality of contact points for receiving fastening elements to anchor the discrete guide elements to the fixed frame.

25. The mechanism of claim 24, wherein the contact points of the discrete guide elements are disposed flush with the contact points for the fasteners of the longitudinal guides, said fasteners for said longitudinal guides being anchored in the fixed frame, and wherein the same type of fasteners affix both the discrete guide elements disposed for the coupling link and the longitudinal guides disposed for the driving-rod.

26. The mechanism of claim 25, wherein the slots in the coupling link are formed as longitudinal slots extending in the direction of the driving rod, and wherein said longitudinal slots, together with the locking pins, determine an idling stroke of the coupling link to thereby shorten the distance of movement of the securing pin between the locking position and the non-locking position with respect to the distance between the first end position and the second end position of the driving rod.

* * * * *